US010504465B2

(12) United States Patent
Li et al.

(10) Patent No.: US 10,504,465 B2
(45) Date of Patent: Dec. 10, 2019

(54) DISPLAY PANEL, DISPLAY DEVICE AND METHOD OF DRIVING THE DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Ting Li, Beijing (CN); Weiyun Huang, Beijing (CN); Zhonglin Cao, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 45 days.

(21) Appl. No.: 15/847,514

(22) Filed: Dec. 19, 2017

(65) Prior Publication Data

US 2018/0211617 A1 Jul. 26, 2018

(30) Foreign Application Priority Data

Jan. 22, 2017 (CN) ..... 2017 1 0053633

(51) Int. Cl.
*G09G 3/36* (2006.01)

(52) U.S. Cl.
CPC ..... *G09G 3/3614* (2013.01); *G09G 3/3677* (2013.01); *G09G 3/3685* (2013.01);
(Continued)

(58) Field of Classification Search
CPC ..... G09G 2300/0439; G09G 2310/067; G09G 2310/08; G09G 2320/0209;
(Continued)

(56) References Cited

U.S. PATENT DOCUMENTS

2006/0202927 A1* 9/2006 Lee ..... G02F 1/1368 345/88
2010/0079363 A1* 4/2010 Chung ..... G09G 3/3614 345/92

(Continued)

FOREIGN PATENT DOCUMENTS

CN 101546542 A 9/2009
CN 103262148 A 8/2013

(Continued)

OTHER PUBLICATIONS

First Office Action for CN Application No. 201710053633.2, dated Aug. 27, 2018.

*Primary Examiner* — Viet D Pham

(74) *Attorney, Agent, or Firm* — Foley & Lardner LLP; James F. Ewing; Paul M. H. Pua

(57) ABSTRACT

The disclosure relates to a display panel, a display device, and related driving method. The display panel comprises: an array of pixel units comprising at least a plurality of rows of first pixel units and a plurality of rows of second pixel units; a scan drive circuit configured to scan the plurality of rows of the first pixel units in a first polarity inversion driving phase, and scans the plurality of rows of the second pixel units in a second polarity inversion driving phase; and a data drive circuit configured to change polarities of data drive signals applied to the plurality of rows of the first pixel units and the plurality of rows of the second pixel units in the first polarity inversion driving phase and the second polarity inversion driving phase, respectively.

9 Claims, 11 Drawing Sheets

(52) U.S. Cl.
CPC ... *G09G 3/3688* (2013.01); *G09G 2300/0439* (2013.01); *G09G 2310/067* (2013.01); *G09G 2310/08* (2013.01); *G09G 2320/0209* (2013.01); *G09G 2330/021* (2013.01)

(58) Field of Classification Search
CPC ..... G09G 2330/021; G09G 3/3614; G09G 3/3677; G09G 3/3685; G09G 3/3688
See application file for complete search history.

(56) References Cited

U.S. PATENT DOCUMENTS

| | | | | |
|---|---|---|---|---|
| 2012/0105494 | A1* | 5/2012 | Lee ..... | G09G 3/3614 345/690 |
| 2016/0035302 | A1* | 2/2016 | Sun ..... | G09G 3/3648 345/209 |

FOREIGN PATENT DOCUMENTS

| | | | |
|---|---|---|---|
| CN | 105243999 | A | 7/2014 |
| CN | 104766588 | A | 7/2015 |
| JP | 11352938 | A | 12/1999 |

* cited by examiner

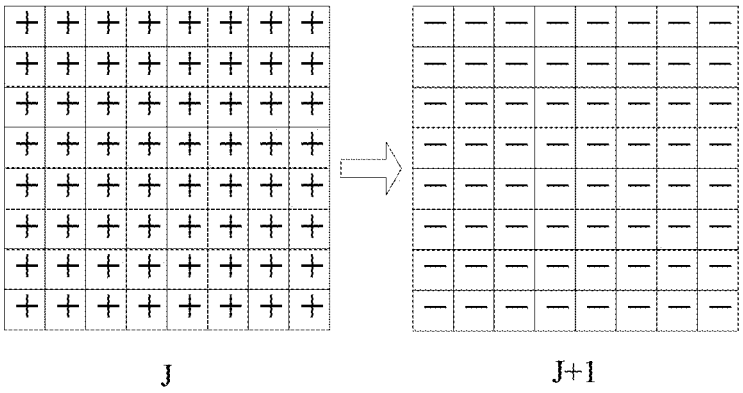
FIG. 1-a
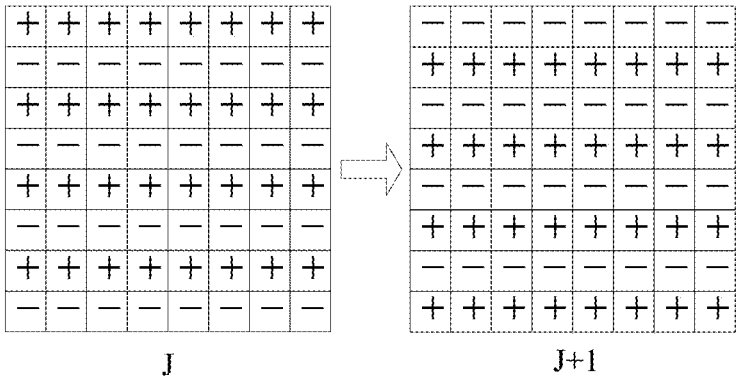
FIG. 1-b
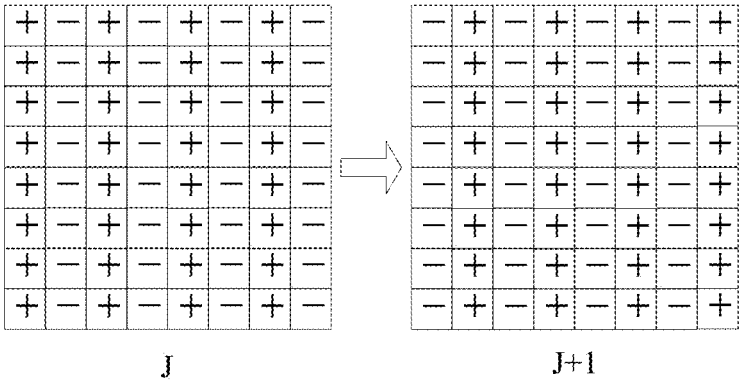
FIG. 1-c

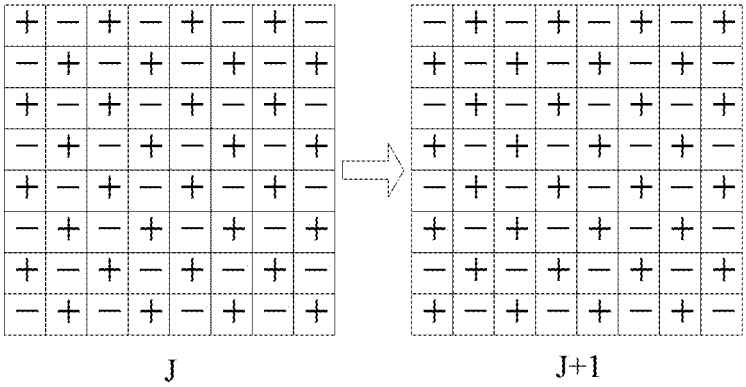
FIG. 1-d
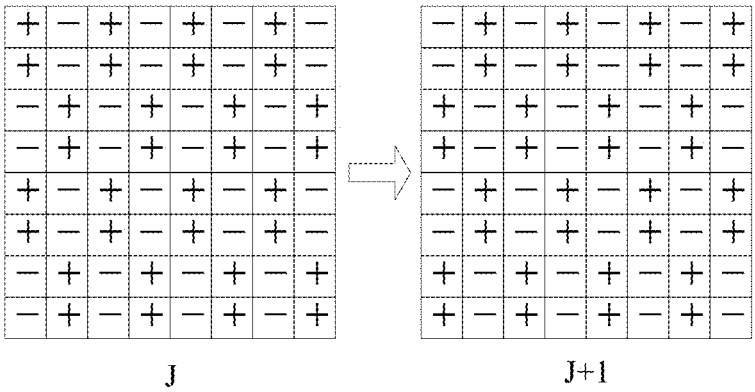
FIG. 1-e
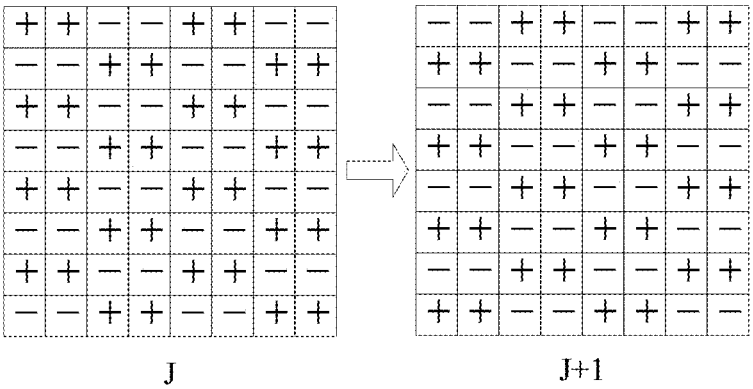
FIG. 1-f

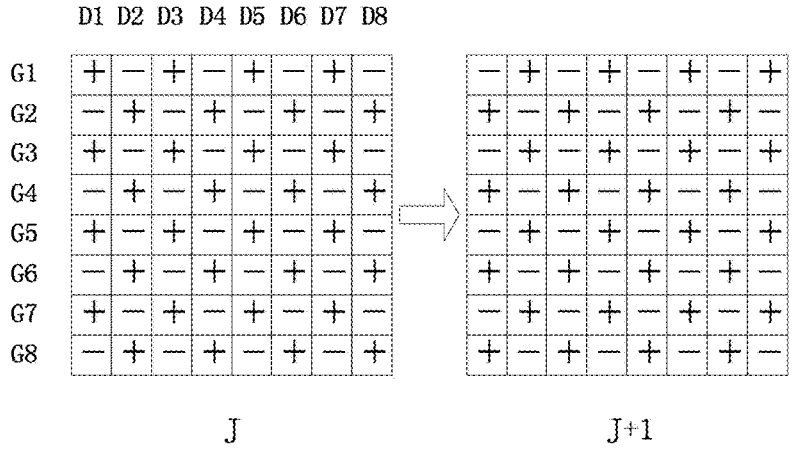
FIG. 2-a
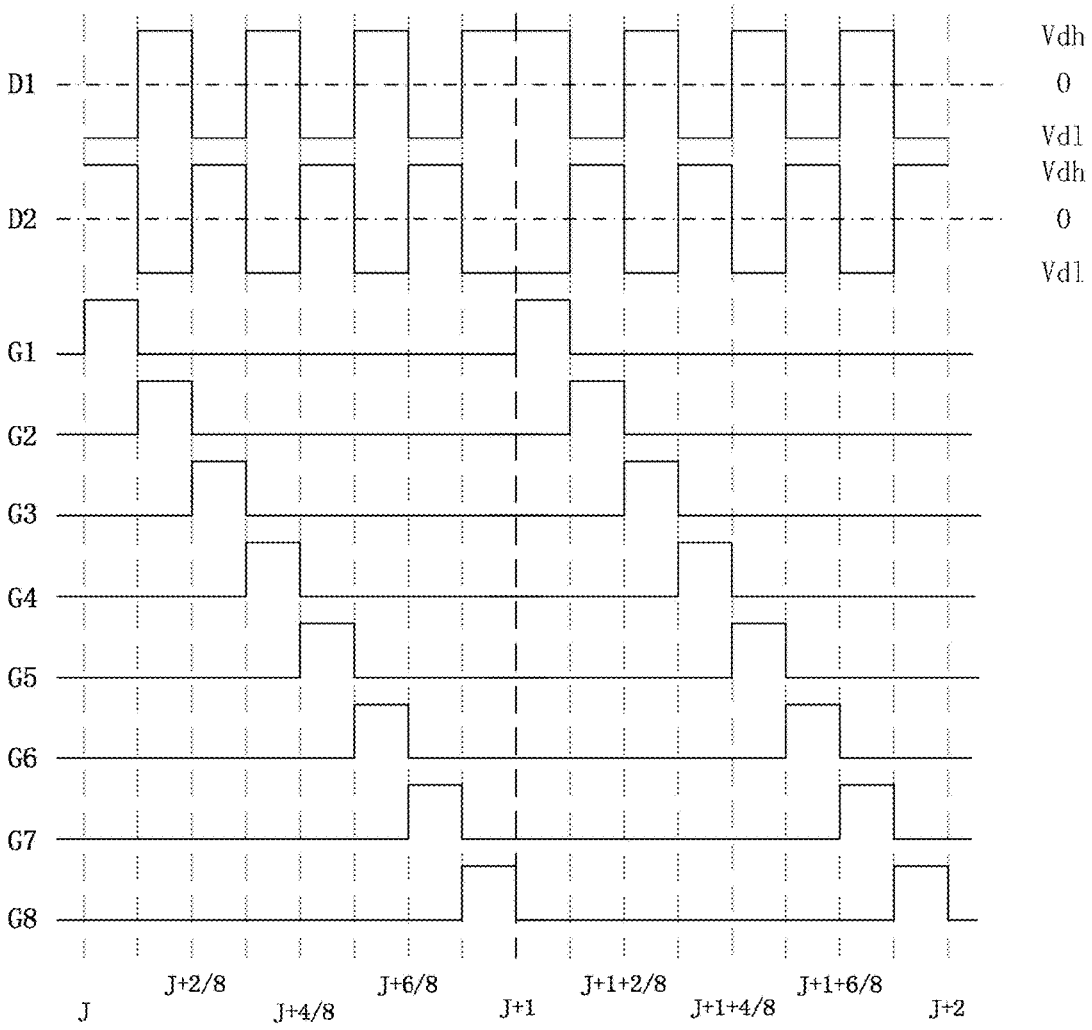
FIG. 2-b

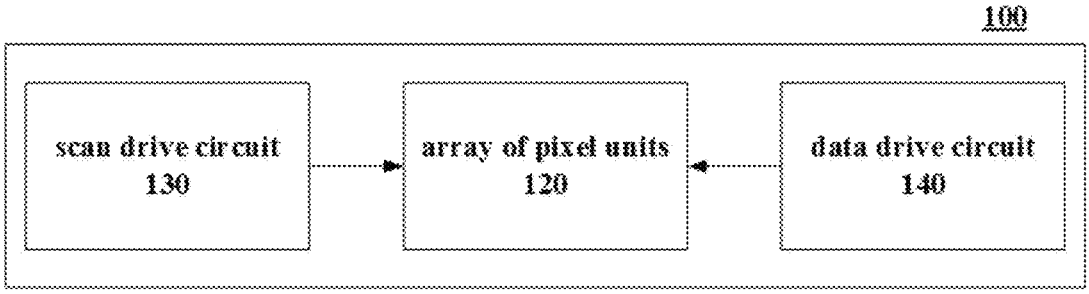
FIG. 3-a
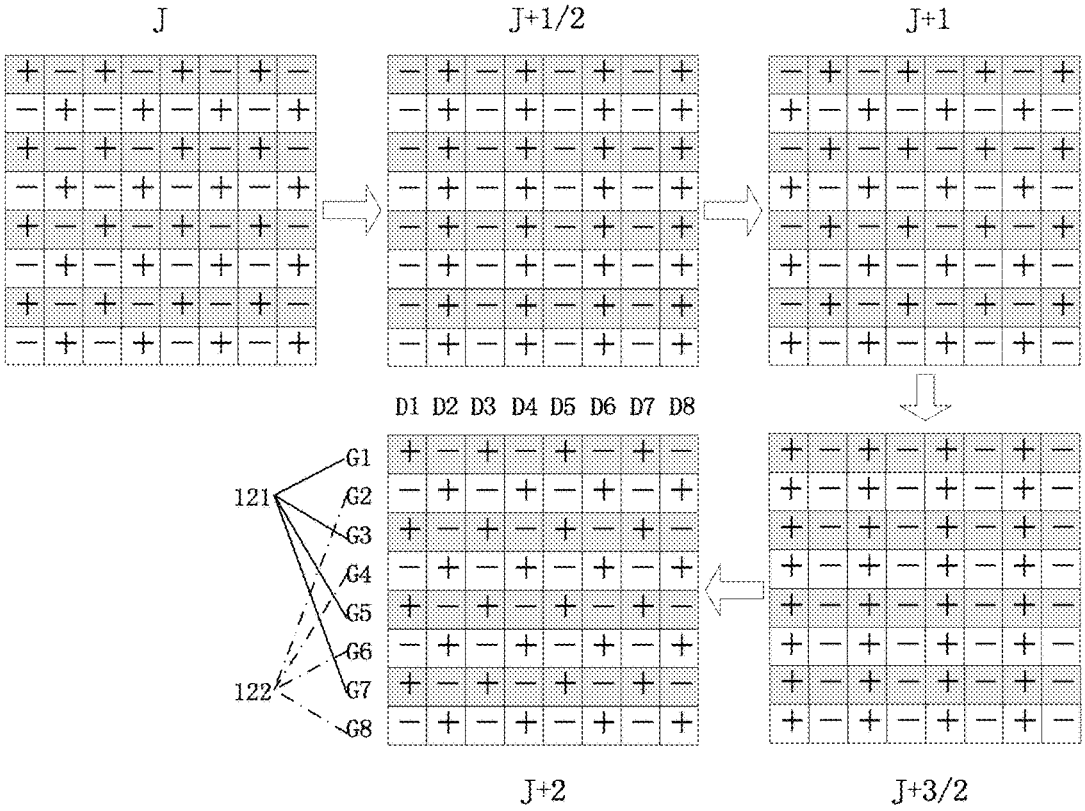
FIG. 3-b

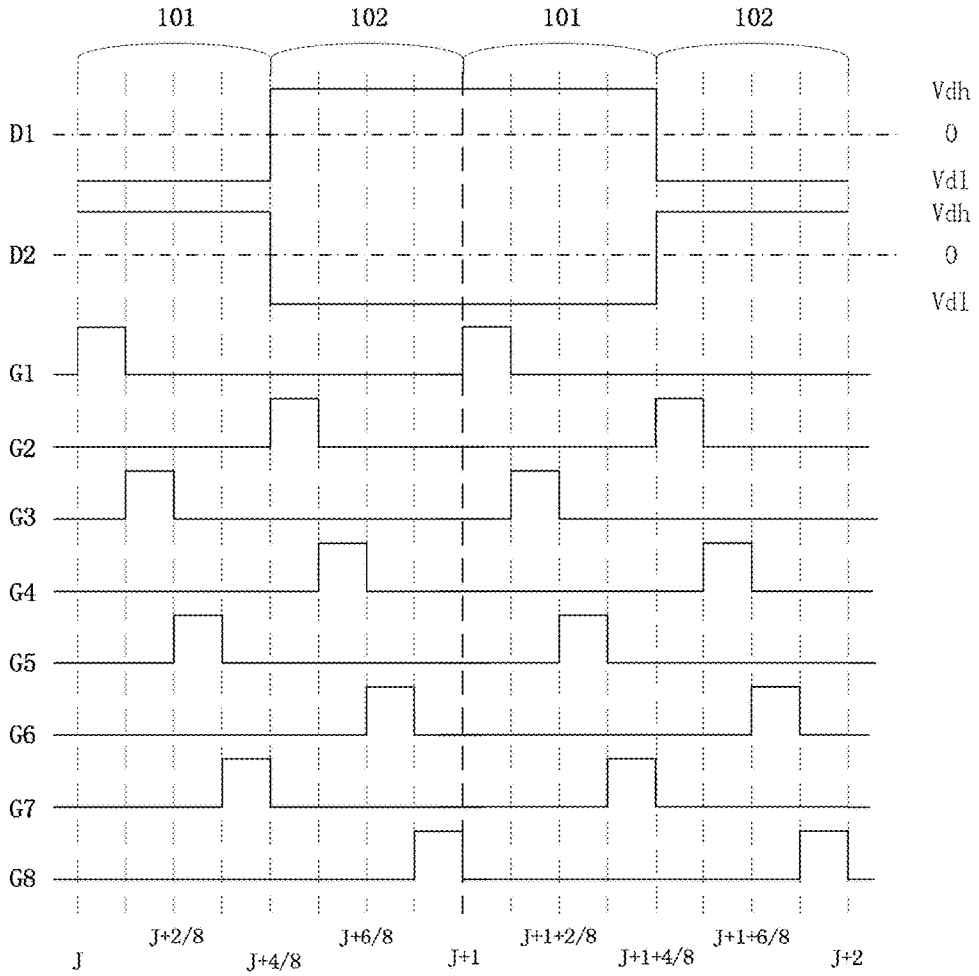
FIG. 3-c
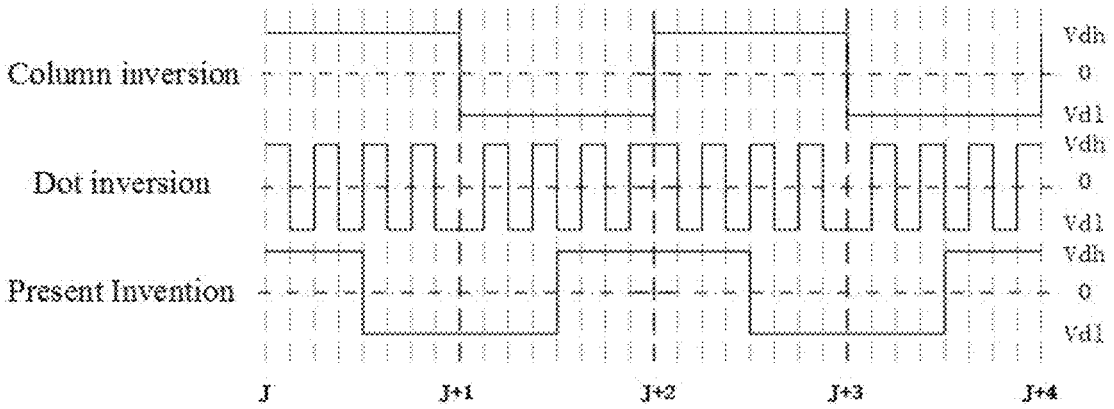
FIG. 3-d

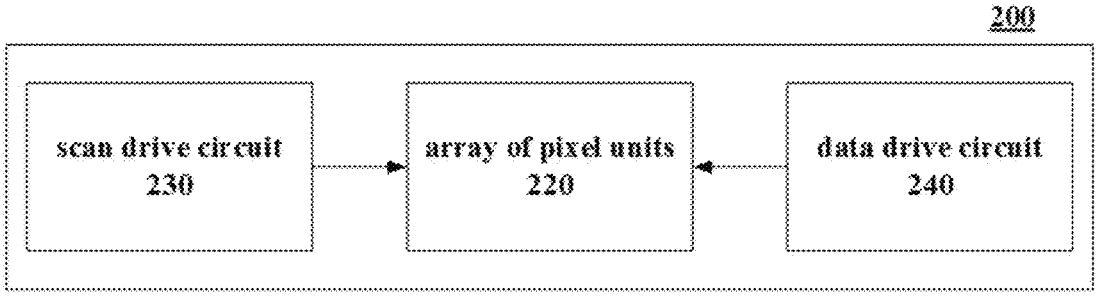
FIG. 4-a
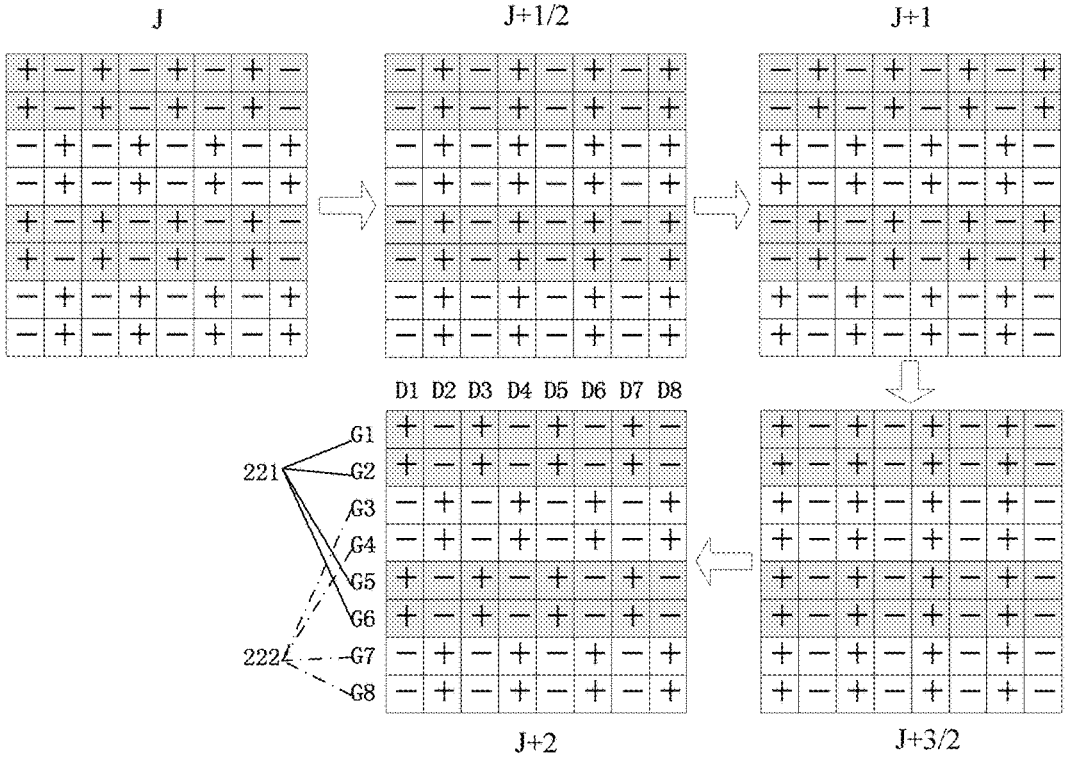
FIG. 4-b

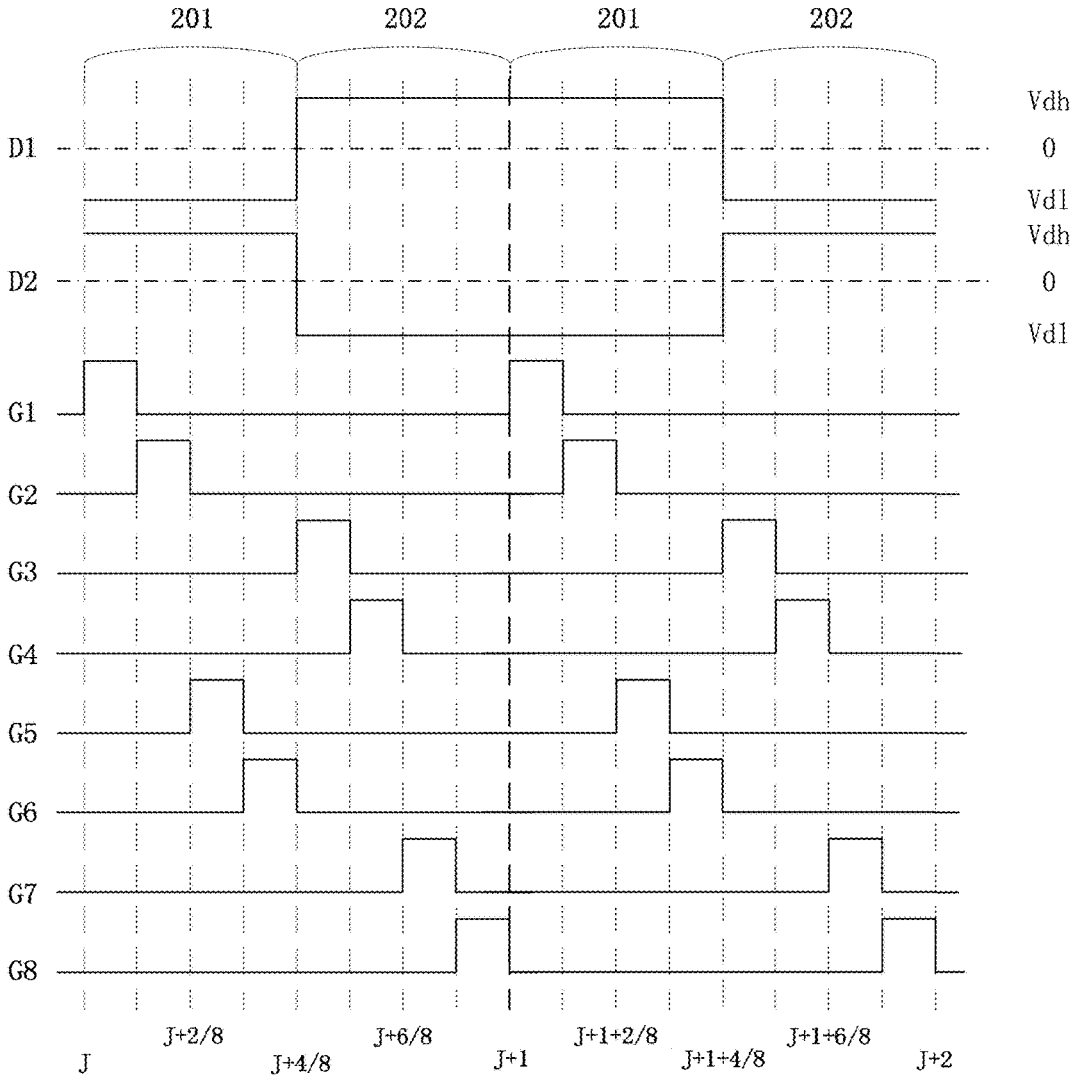
FIG. 4-c
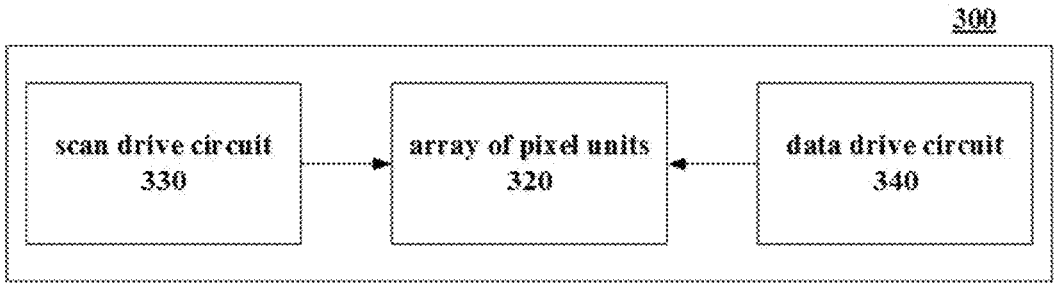
FIG. 5-a

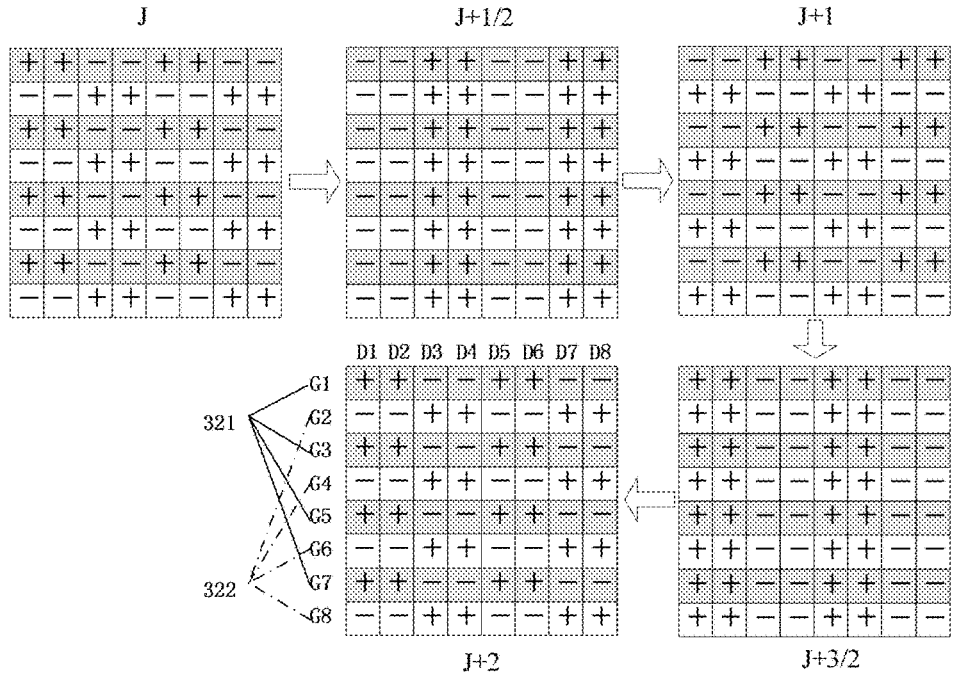
FIG. 5-b
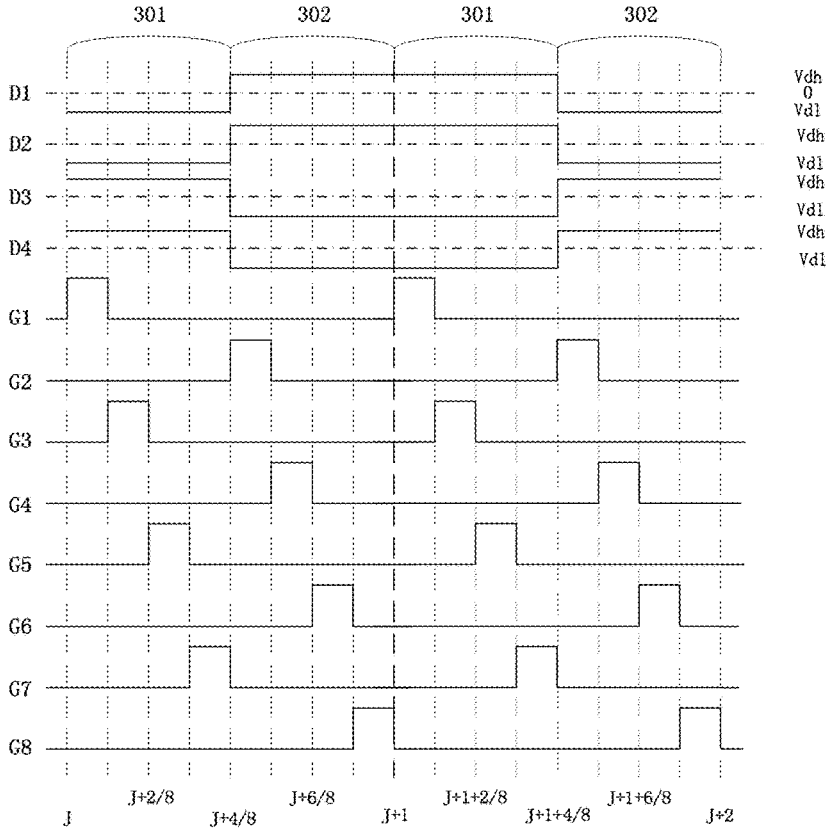
FIG. 5-c

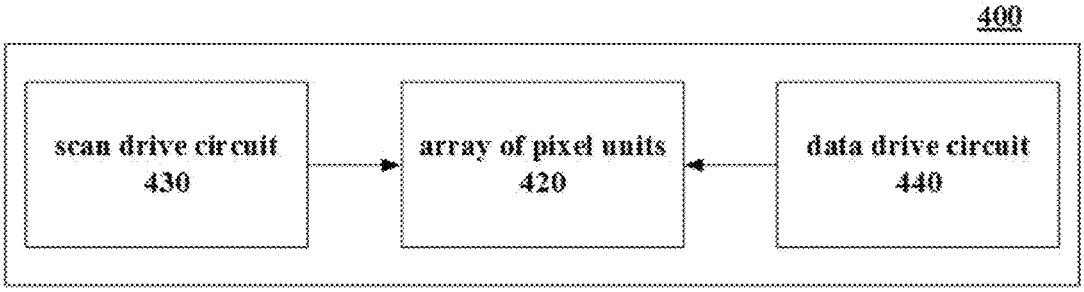
FIG. 6-a
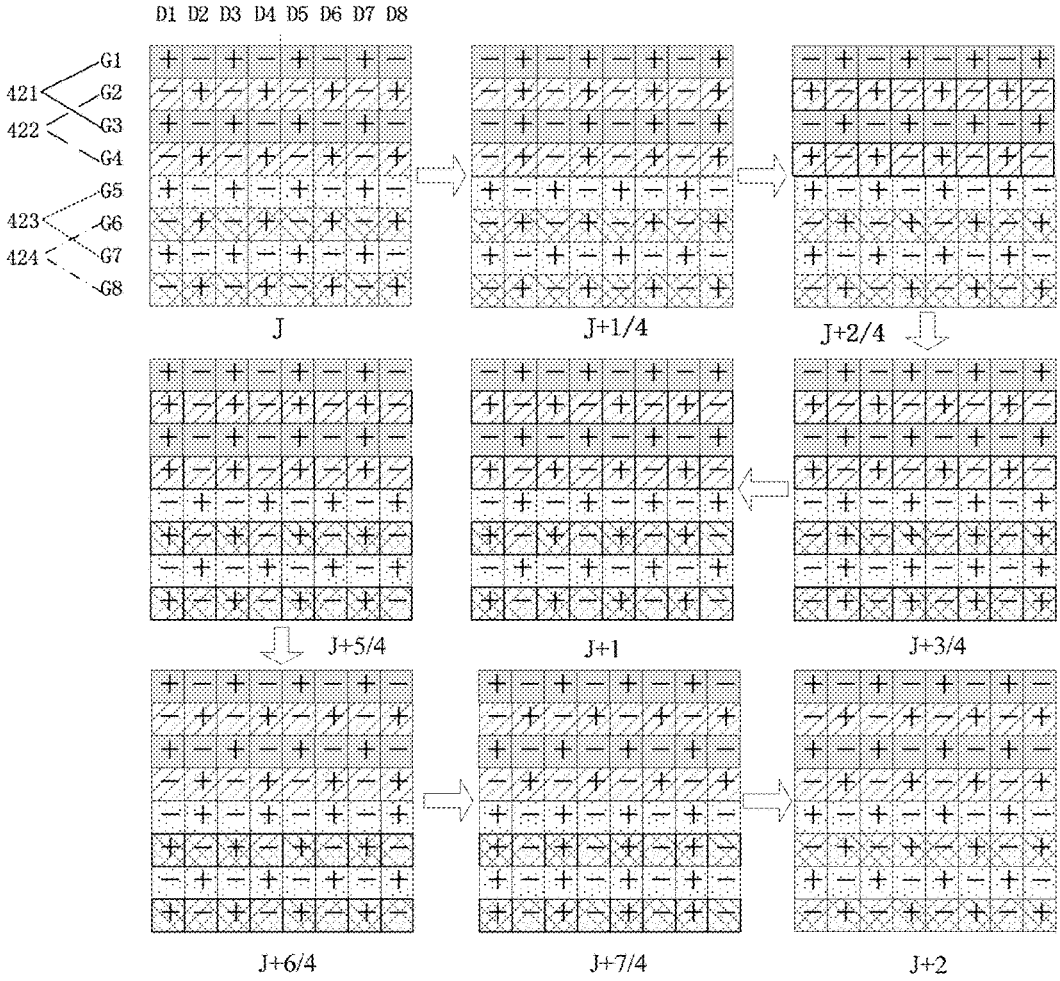
FIG. 6-b

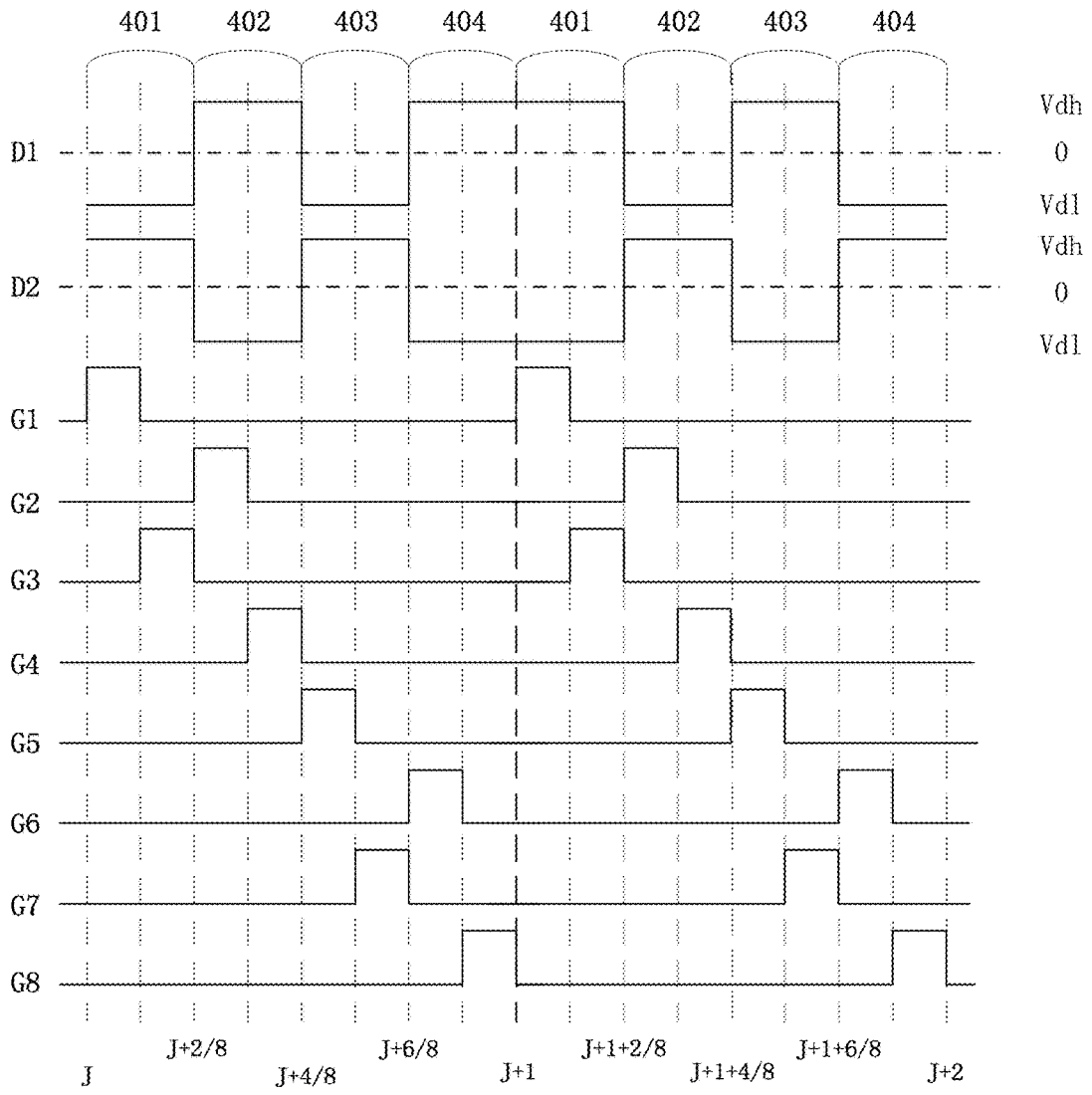
FIG. 6-c
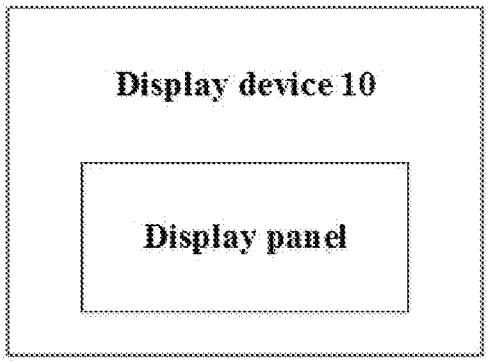
FIG. 7

DISPLAY PANEL, DISPLAY DEVICE AND METHOD OF DRIVING THE DISPLAY DEVICE

CROSS-REFERENCE TO RELATED APPLICATIONS

This application claims priority to Chinese Patent Application No. 201710053633.2, filed on Jan. 22, 2017, which is hereby incorporated by reference in its entirety.

TECHNICAL FIELD

The embodiments of the present disclosure relate to a display panel, a display device and a method of driving the display device.

BACKGROUND

Liquid Crystal Display (LCD), due to its low power consumption, is increasingly favored by consumers and applies to various kinds of electrode devices. The main principle of LCD is to control alignments of liquid crystal molecules to change light transmittance by use of an electric field, to display an image. The pixel electrodes and common electrodes comprised in the liquid crystal display are generally named drive electrodes. Since a voltage of the common electrode is generally maintained unchanged, positive or negative of the polarity of the drive electrode is with respect to the common electrode. When the voltage of the pixel electrode is higher than the voltage of the common electrode, the drive electrode is referred to as having a positive polarity, and when the voltage of the pixel electrode is lower than the voltage of the common electrode, the drive electrode is referred to as having a negative polarity. For example, if the voltage of the common electrode is 1V, then the drive electrode has a positive polarity when the voltage of the pixel electrode is 3V, and the drive electrode has a negative polarity when the voltage of the pixel electrode is −1V.

In an actual display process, if the liquid crystal molecules continuously work under one polarity, the liquid crystal molecules will be damaged and cannot be recovered. Therefore, it is required to inverse the polarity of the drive electrode at intervals, that is, the positive polarity and the negative polarity of the drive electrode are interchanged, such that electric fields in opposite directions are applied to the liquid crystal molecules at different times. Since a magnitude of deflection angle of the liquid crystal molecules and the gray scale of the pixels depend on a magnitude of the electric field formed by the drive electrode (e.g., depend on a difference between voltages of the pixel electrode and the common electrode), the direction of rotation angle of the liquid crystal molecules depends on the polarity of the drive electrode, so polarity inversion will not affect the gray scale displayed by the pixels. For instance, in case where the voltage of the common electrode is 1V as described above, the magnitude of defection angle of the liquid crystal when the voltage of the pixel electrode is 3V is identical with that when the voltage of the pixel electrode is −1V, that is, the liquid crystal molecules have the same transmittance under the aforementioned two voltages of the pixel electrode.

SUMMARY

Some embodiments of the present disclosure provide a display panel comprising an array of pixel units, a scan drive circuit and a data drive circuit. The array of pixel units comprises a plurality of pixel units aligned in an array, and comprises at least a plurality of rows of first pixel units and a plurality of rows of second pixel units, at least two rows of the first pixel units or at least two rows of the second pixel units being not adjacent to each other. The scan drive circuit is configured to scan the array of pixel units such that an image scan period for driving the array of pixel units comprises at least a first polarity inversion driving phase continuous in time and a second polarity inversion driving phase continuous in time. The data drive circuit is configured to provide data signals to the array of pixel units. The scan drive circuit scans the plurality of rows of the first pixel units in the first polarity inversion driving phase, and scans the plurality of rows of the second pixel units in the second polarity inversion driving phase, and the data drive circuit changes polarities of data drive signals applied to the plurality of rows of the first pixel units and the plurality of rows of the second pixel units in the first polarity inversion driving phase and the second polarity inversion driving phase, respectively.

Another embodiments of the present disclosure provide a display device comprising the aforementioned display panel.

Further embodiments of the present disclosure provide a driving method comprising: scanning a plurality of rows of first pixel units of an array of pixel units in a first polarity inversion driving phase continuous in time; scanning a plurality of rows of second pixel units of the array of pixel units in a second polarity inversion driving phase continuous in time, wherein at least two rows of the first pixel units or at least two rows of the second pixel units being not adjacent to each other, and an image scan period for driving the array of pixel units comprises at least the first polarity inversion driving phase and the second polarity inversion driving phase; and changing polarities of data drive signals applied to the plurality of rows of the first pixel units in the first polarity inversion driving phase and changing polarities of data drive signals applied to the plurality of rows of the second pixel units in the second polarity inversion driving phase.

BRIEF DESCRIPTION OF THE DRAWINGS

In order to describe the technical solutions of the embodiments of the present disclosure more clearly, the drawings used for describing the embodiments or related technologies are introduced briefly below, and obviously, the drawings described below merely relate some embodiments of the present disclosure, and are not intended to limit the present disclosure.

FIG. 1-*a* is an exemplary diagram showing pixel voltage polarity of frame inversion;

FIG. 1-*b* is an exemplary diagram showing pixel voltage polarity of row inversion;

FIG. 1-*c* is an exemplary diagram showing pixel voltage polarity of column inversion;

FIG. 1-*d* is an exemplary diagram showing pixel voltage polarity of dot inversion;

FIG. 1-*e* is an exemplary diagram showing pixel voltage polarity of column 2-dot inversion;

FIG. 1-*f* is an exemplary diagram showing pixel voltage polarity of row 2-dot inversion;

FIG. 2-*a* is a schematic diagram showing an exemplary driving method of dot inversion;

FIG. 2-*b* is an illustrative drive waveform of the driving method of dot inversion shown in FIG. 2-*a;*

FIG. 3-*a* is an illustrative block diagram showing a display panel provided according to some embodiments of the present disclosure;

FIG. 3-*b* is a schematic diagram showing a driving method carried out by the array of pixel units and the scan drive circuit and the data drive circuit of the display panel shown in FIG. 3-*a;*

FIG. 3-*c* is an illustrative drive waveform of the driving method shown in FIG. 3-*b;*

FIG. 3-*d* is a diagram showing a comparison made between the illustrative drive waveform of the driving method shown in FIG. 3-*b* and the illustrative drive waveforms of the driving methods of column inversion and dot inversion;

FIG. 4-*a* is an illustrative block diagram showing another display panel provided according to some embodiments of the present disclosure;

FIG. 4-*b* is a schematic diagram showing a driving method carried out by the array of pixel units and the scan drive circuit and the data drive circuit of the display panel shown in FIG. 4-*a;*

FIG. 4-*c* is an illustrative drive waveform of the driving method shown in FIG. 4-*b;*

FIG. 5-*a* is an illustrative block diagram showing a further display panel provided according to some embodiments of the present disclosure;

FIG. 5-*b* is a schematic diagram showing a driving method carried out by the array of pixel units and the scan drive circuit and the data drive circuit of the display panel shown in FIG. 5-*a;*

FIG. 5-*c* is an illustrative drive waveform of the driving method shown in FIG. 5-*b;*

FIG. 6-*a* is an illustrative block diagram showing a further display panel provided according to some embodiments of the present disclosure;

FIG. 6-*b* is a schematic diagram showing a driving method carried out by the array of pixel units and the scan drive circuit and the data drive circuit of the display panel shown in FIG. 6-*a;*

FIG. 6-*c* is an illustrative drive waveform of the driving method shown in FIG. 6-*b;*

FIG. 7 is an illustrative block diagram showing a display device provided according to another embodiments of the present disclosure.

DETAILED DESCRIPTION

Figure 8:
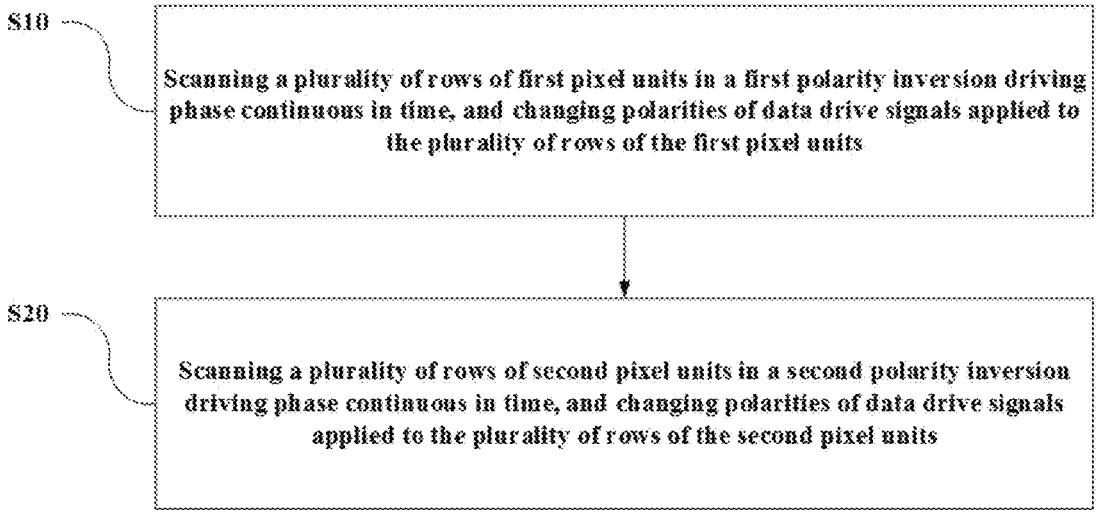
FIG. 8 shows a driving method of a display device provided according to further embodiments of the present disclosure.

The technical solutions in the embodiments of the present disclosure will be described clearly and completely below with reference to the accompanying drawings. By referring to non-limiting illustrative embodiments shown in the accompanying drawings and described in detail below, the illustrative embodiments of the present disclosure and their various features and beneficial details are described more comprehensively. It should be noted that, the features shown in the drawings are not necessarily drawn to scale. Known materials, components and techniques are omitted from the present disclosure so as not to blur the illustrative embodiments of the present disclosure. The examples given herein are only intended to facilitate in understanding the implementations of the illustrative embodiments of the present disclosure, and further enable those skilled in the art to implement the illustrative embodiments. Therefore, the examples should not be construed as limiting the scope of the embodiments of the present disclosure.

Unless otherwise particularly defined, the technical terms or scientific terms used in the present disclosure shall have the general meanings that can be understood by those ordinarily skilled in the art. The words "first", "second" or the like used in the present disclosure do not represent any order, number or importance, but are used for discriminating different components. Furthermore, in the embodiments of the present disclosure, identical or similar reference signs represent identical or similar composite parts.

The polarity inversion modes of the liquid crystal display device mainly comprise frame inversion, row inversion, column inversion, dot inversion, column 2-dot inversion, row 2-dot inversion, in total six. FIGS. 1-*a* to 1-*f* respectively show the pixel voltage polarity of frame inversion, row inversion, column inversion, dot inversion, column 2-dot inversion, row 2-dot inversion. As shown in FIG. 1-*a*, in the same frame image, each pixel unit maintains the drive mode with the same polarity, which is called frame inversion. As shown in FIG. 1-*b*, in the same frame image, pixel units in each row have the same polarity, and the drive mode in which pixel units in any row have a polarity opposite to the polarity of pixel units in an adjacent row is called row inversion. As shown in FIG. 1-*c*, in the same frame image, pixel units in each column have the same polarity, and the drive mode in which pixel units in any column have a polarity opposite to the polarity of pixel units in an adjacent column is called column inversion. As shown in FIG. 1-*d*, in the same frame image, the drive mode in which each pixel unit maintains a polarity opposite to the polarities of its adjacent up, down, left, right four pixel units is called dot inversion. As shown in FIG. 1-*e*, in the same frame image, two pixel units in the column direction are defined as a pixel subset, and two pixel units in each pixel subset have the same polarity, an each pixel subset maintains a polarity opposite to the polarities of its adjacent up, down, left and right four pixel subsets; such a drive mode is called column 2-dot inversion. As shown in FIG. 1-*f*, in the same frame image, two pixel units in the row direction are defined as a pixel subset, and two pixel units in each pixel subset have the same polarity, an each pixel subset maintains a polarity opposite to the polarities of its adjacent up, down, left and right four pixel subsets; such a drive mode is called row 2-dot inversion.

The inventors have noticed that, although frame inversion and column inversion driving methods have less power consumption, display imperfections such as crosstalk easily occurs. However, for the dot inversion, column 2-dot inversion and row 2-dot inversion driving methods, though they can attain a good display effect, they have a larger power consumption. Dot inversion is described below as an example.

FIG. 2-*a* is a diagram showing pixel voltage polarity of the driving method of dot inversion, and FIG. 2-*b* is an illustrative drive waveform of the driving method of dot inversion shown in FIG. 2-*a*. As shown in FIG. 2-*a* and FIG. 2-*b*, for the dot inversion driving method, in a scan process of switching from J frame image to J+1 frame image, the scan drive circuit turns on the pixels units in rows G1-G8 in turn, and the data drive circuit at the same time provides data signals to the pixel units in columns D1-D8 (for example, providing through a data line set for each column of the pixel units data signals to the pixel units in the column).

For example, in the scan process of switching from J frame image to J+1 frame image, for the pixel units in the column D1, during the period when the pixel units in the row G1 are turned on, the data drive circuit should provide them with a low level (i.e., negative polarity), during the period when the pixel units in the row G2 are turned on, the data drive circuit should provide them with a high level (i.e., positive polarity), during the period when the pixel units in the row G3 are turned on, the data drive circuit should provide them with a low level, and during the period when the pixel units in the row G4, G5, G6, G7 or G8 are turned on, the data drive circuit should provide them with a high level, a low level, a high level, a low level, and a high level, respectively; for the pixel units in column D2, during the period when the pixel units in the row G1, G2, G3, G4, G5, G6, G7 or G8 are turned on, the data drive circuit should provide them with a high level, a low level, a high level, a low level, a high level, a low level, a high level, a low level, respectively, wherein each switch will result in energy consumption.

That is, since any two adjacent pixel units in the column direction in each column (e.g., column D1) of pixel units have opposite polarities, during an image scan period (i.e., a display period of one frame image), for each column of pixel units, the data drive circuit needs to perform a switch between high level and low level from the period in which one row of pixels units are turned to the period in which a next row of pixel units are turned on. However, regarding column inversion, for each column of pixel units, the data drive circuit should perform a switch between high level and low level only in one image scan period. Therefore, the dot inversion driving method has a power consumption far higher than that of the column inversion driving method.

The embodiments of the present disclosure provide a display panel, a display device, and a method of driving the display device. By making an image scan period for driving the array of pixel units comprise at least a first polarity inversion driving phase continuous in time and a second polarity inversion driving phase continuous in time, the display panel, the display device, and the method of driving the display device reduce the power consumption of polarity inversion under the condition that a display effect is guaranteed, and crosstalk during the display process can be also avoided.

Any polarity inversion driving phase (e.g., a first polarity inversion driving phase, a second polarity inversion driving phase, a third polarity inversion driving phase, or a fourth polarity inversion driving phase) in the present disclosure refers to a period continuous in time.

At least some embodiments of the present disclosure provides a display panel comprising an array of pixel units, a scan drive circuit and a data drive circuit. The array of pixel units comprises a plurality of pixel units aligned in an array, and comprises at least a plurality of rows of first pixel units and a plurality of rows of second pixel units, at least two rows of the first pixel units or at least two rows of the second pixel units being not adjacent to each other. The scan drive circuit is configured to scan the array of pixel units such that an image scan period for driving the array of pixel units comprises at least a first polarity inversion driving phase continuous in time and a second polarity inversion driving phase continuous in time. The data drive circuit is configured to provide data signals to the array of pixel units. The scan drive circuit scans the plurality of rows of the first pixel units in the first polarity inversion driving phase, and scans the plurality of rows of the second pixel units in the second polarity inversion driving phase, and the data drive circuit changes polarities of data drive signals applied to the plurality of rows of the first pixel units in the first polarity inversion driving phase and changes polarities of data drive signals applied to the plurality of rows of the second pixel units in the second polarity inversion driving phase.

For example, some embodiments of the present disclosure provides a display panel 100. FIG. 3-*a* is an illustrative block diagram showing a display panel 100 provided according to some embodiments of the present disclosure. As shown in FIG. 3-*a*, the display panel 100 comprises an array of pixel units 120, a scan drive circuit 130 and a data drive circuit 140. For example, according to actual application requirements, the functions of the scan drive circuit 130 and the data drive circuit 140 in the embodiments can be also implemented by the same integrated drive circuit, and the functions of the scan drive circuit and the data drive circuit in other embodiments described below can be also implemented by the same integrated drive circuit.

For example, FIG. 3-*b* is a schematic diagram showing a driving method carried out by the array of pixel units 120, the scan drive circuit 130 and the data drive circuit 140 of the display panel 100 provided according to some embodiments of the present disclosure. As shown in FIG. 3-*b*, the array of pixel units 120 comprises a plurality of pixel units aligned in an array, and the array of pixel units 120 may comprise four rows of first pixel units 121 and four rows of second pixel units 122. The first pixel units 121 may comprise pixel units in odd rows (e.g., G1, G3, G5 and G7) and the second pixel units 122 may comprise pixel units in even rows (e.g., G2, G4, G6 and G8). Apparently, the number of rows of the first pixel units 121 and the second pixel units 122 comprised in the array of pixel units 120 in the present embodiments is merely illustrative, and according to actual application requirements, and the number of rows of the first pixel units 121 and the second pixel units 122 can be set as 640, 1080 or other numbers that satisfy actual application requirements. For example, according to actual application requirements, the first pixel units 121 may instead comprise pixel units in even rows (e.g., G2, G4, G6 and G8), and the second pixel units 122 may further comprise pixel units in odd rows (e.g., G1, G3, G5 and G7), and the embodiments of the present disclosure do not make specific limitations.

For example, FIG. 3-*c* is an illustrative drive waveform of the driving method shown in FIG. 3-*b*. As shown in FIG. 3-*b* and FIG. 3-*c*, the scan drive circuit 130 is configured to scan the array of pixel units 120 such that an image scan period for driving the array of pixel units 120 comprises a first polarity inversion driving phase 101 continuous in time and a second polarity inversion driving phase 102 continuous in time. For example, the first polarity inversion driving phase 101 as shown in FIG. 3-*c* is a period of time from J to J+1/2 (briefly referred to as J–J+1/2, or the like) or a period of time from J+1 to J+3/2; the second polarity inversion driving phase 102 is a period of time from J+1/2 to J+1 or a period of time from J+3/2 to J+2, and so on. For example, J may represents Jth frame image, and a refresh time from the Jth frame image to J+1 th frame image may represent one image scan period, that is, the image scan period equals the refresh time of one frame image. For example, according to actual application requirements, it can be set that the display panel completes once inversion during a plurality of image scan periods, for example, polarity inversion of the display panel may be completed once during five image scan periods, and the embodiments of the present application do not make specific limitations. For example, for clarity, the present embodiments only illustratively shows two image scan periods, but in actual applications, the number of the image scan periods may be set according to the display time of the display panel 100.

For example, the drive waveform shown in FIG. 3-*c* is merely illustrative, and since in the actual drive process of the display panel, fluctuations may occur in the voltage, so the actual drive waveform may have a certain fluctuation relative to the drive waveform shown in FIG. 3-*c*.

For example, the data drive circuit 140 may be configured to provide data signals to the array of pixel units 120. For example, for the array of pixel units 120 of the display panel 100 shown in FIG. 3-*b*, a data line may be set for each column of pixel units in the D1-D8 columns of pixel units respectively, and the data drive circuit 140 may provide data signals to the column of pixel units through the respective data line set for each column of pixel units. Apparently, the number of columns of the pixel units comprised in the array of pixel units 120 in the present embodiments is merely illustrative, and the number of columns of the pixel units may be set as 480, 768 or other numbers that satisfy actual application requirements.

For example, the scan drive circuit 130 scans the plurality of rows of the first pixel units 121 in the first polarity inversion driving phase 101, and scans the plurality of rows of the second pixel units 122 in the second polarity inversion driving phase 102, and the data drive circuit 140 changes polarities of data drive signals applied to the plurality of rows of the first pixel units 121 and the plurality of rows of the second pixel units 122 in the first polarity inversion driving phase 101 and the second polarity inversion driving phase 102, respectively. For example, in the first polarity inversion driving phase 101 (e.g., J–J+1/2), the scan drive circuit 130 may turn on pixel units in odd rows in turn, and the data drive circuit 140 may change the polarity of data drive signals applied to the pixel units in column D1 in the plurality of rows of the first pixel units 121 from positive polarity to negative polarity in turn (e.g. by supplying low level to the pixel units as discussed). Also for example, in the second polarity inversion driving phase 102 (e.g., J+1/2–J+1), the scan drive circuit 130 may turn on pixel units in even rows in turn, and the data drive circuit 140 may change the polarity of data drive signals applied to the pixel units in the column D1 in the plurality of rows of the second pixel units 122 from negative polarity to positive polarity in turn (e.g. by supplying high level to the pixel units as discussed). Again for example, in the first polarity inversion driving phase 101 (e.g., J+1–J+3/2), the scan drive circuit 130 may turn on pixel units in odd rows in turn, and the data drive circuit 140 may change the polarity of data drive signals applied to the pixel units in the column D1 in the plurality of rows of the first pixel units 121 from negative polarity to positive polarity in turn (e.g. by supplying high level to the pixel units as discussed).

For example, the data drive circuit 140 may be further configured to apply data drive signals with opposite polarities to pixel units in adjacent columns in any one of the first polarity inversion driving phase 101 and the second polarity inversion driving phase 102. For example, as shown in FIG. 3-*c*, the data drive circuit 140 may be configured to provide a data drive signal (the square wave drive signal represented as D1 in FIG. 3-*c*) to the column D1, and to provide the pixel units in the column D2 with another data drive signal with a polarity opposite to the polarity of the column D1 (the square wave drive signal represented as D2 in FIG. 3-*c*). Also for example, the data drive circuit 140 may be configured to provide the odd columns (e.g. columns D1, D3, D5 and D7) with the same data drive signal as the column D1, and to provide the even columns (e.g. columns D2, D4, D6 and D8) with a data drive signal with a polarity opposite to the polarity of the column D1. For example, the data drive circuit 140 may be configured to apply a negative polarity to the pixel units in columns D1, D3, D5 and D7 in the plurality of rows of the first pixel units 121, and to apply a positive polarity to the pixels units in columns D2, D4, D6 and D8 in the plurality of rows of the first pixel units 121, in the first polarity inversion driving phase 101. Also for example, the data drive circuit 140 may be configured to apply a positive polarity to the pixel units in columns D1, D3, D5 and D7 in the plurality of rows of the second pixel units 122, and to apply a negative polarity to the pixels units in columns D2, D4, D6 and D8 in the plurality of rows of the second pixel units 122, in the second polarity inversion driving phase 102.

For example, as shown in FIG. 3-*b*, for each frame image (e.g., Jth image, J+1 th image, J+2 th image), each pixel unit maintains a polarity opposite to that of adjacent up, down, left, right four pixel units. That is, the pixel voltage polarity diagram of each frame image is identical with the pixel voltage polarity diagram of the dot inversion driving method. Therefore, the driving method carried out by the scan drive circuit 130 and the data drive circuit 140 of the display panel 100 provided according to the present embodiments can attain a similar display effect to the dot inversion driving method.

For example, FIG. 3-*d* is a diagram showing comparisons made between the illustrative drive waveform of the driving method shown in FIG. 3-*b* and the illustrative drive waveforms of the column inversion and dot inversion driving methods. As shown in FIG. 3-*d*, the data drive waveform of the driving method carried out by the scan drive circuit 130 and the data drive circuit 140 of the display panel 100 provided according to the present embodiments is similar to the data drive waveform of column inversion. Since in the refresh time of one frame image, for each column of pixel units, the data drive circuit 140 is only required to change the polarity of the applied signals once, in case where other components are similar, the power consumption of the driving method provided according to the present embodiments is substantially the same with that of column inversion. That is, the driving method according to the present embodiments may achieve the same display effect as the dot inversion with the same power consumption as column inversion. Therefore, the driving method provided according to the present embodiments achieves the purpose of using a low power consumption drive mode for reaching a good display effect.

For example, the power consumption $P_1$ of the driving method provided by the present embodiments and the power consumption $P_d$ of the dot inversion driving method can satisfy the following conditions:

$$P_1=\tfrac{1}{2}(C_{data}N_xN_y\times 3)V^2(f\times 2)$$

$$P_d=(C_{data}N_xN_y\times 3)V^2(f\times N_y)$$

Where $N_x$ is a resolution in the horizontal direction, $N_y$ is a resolution in the vertical direction, $C_{data}$ is a capacitance of one pixel unit, f is a polarity inversion frequency (e.g., the polarity inversion frequency may be set as a refresh frequency of the image), and V is a data signal voltage provided by the data drive circuit 140.

Since $2 \ll N_y$, the power consumption of the driving method carried out by the scan drive circuit 130 and the data drive circuit 140 of the display panel 100 provided according to the present embodiments may be far less than the power consumption of the dot inversion driving method, and by considering that the driving method provided by the present embodiments can attain a display effect similar to the dot inversion driving method, the display panel 100 provided by the present embodiments reduces the power consumption of polarity inversion under the condition that a display effect is guaranteed.

For example, FIG. 4-*a* is an illustrative block diagram showing another display panel 200 provided according to some embodiments of the present disclosure. As shown in FIG. 4-*a*, the display panel 200 comprises an array of pixel units 220, a scan drive circuit 230 and a data drive circuit 240. For example, FIG. 4-*b* is a schematic diagram showing a driving method carried out by the array of pixel units 220, the scan drive circuit 230 and the data drive circuit 240 of the another display panel 200 provided according to some embodiments of the present disclosure. FIG. 4-*c* is an illustrative drive waveform of the driving method shown in FIG. 4-*b*.

For example, as compared with the display panel and the array of pixel units shown in FIGS. 3-*a* to 3-*c*, as shown in FIG. 4-*b* and FIG. 4-*c*, the first pixel units 221 may comprise pixel units in row 4I+1 and in row 4I+2, and the second pixel units 222 may comprise pixel units in row 4I+3 and in row 4I+4, where I is an integer greater than or equal to 0 and smaller than or equal to C/4−1, and C is a number of rows of the array of pixel units 220, which may be, e.g., a positive integer multiple of 4, but it is not limited thereto. For example, the first pixel units 221 may comprise pixel units in rows G1, G2, G5 and G6, and the second pixel units 222 may comprise pixel units in rows G3, G4, G7 and G8.

For example, the scan drive circuit 230 scans the plurality of rows of the first pixel units 221 in the first polarity inversion driving phase 201, and scans the plurality of rows of the second pixel units 222 in the second polarity inversion driving phase 202, and the data drive circuit 240 changes the polarities of data drive signals applied to the plurality of rows of the first pixel units 221 and the plurality of rows of the second pixel units 222 in the first polarity inversion driving phase 201 and the second polarity inversion driving phase 202, respectively. For example, in the first polarity inversion driving phase 201 (e.g. from J to J+1/2), the scan drive circuit 230 turns on pixel units in rows G1, G2, G5 and G6 in turn, and the data drive circuit 240 changes the polarity of data drive signals applied to the pixel units in the rows G1, G2, G5 and G6 in the pixel units in the column D1 from positive polarity to negative polarity in turn (e.g. by providing low level to the pixel units as discussed). Also for example, in the second polarity inversion driving phase 202 (e.g. from J+1/2 to J+1), the scan drive circuit 230 turns on pixel units in rows G3, G4, G7 and G8 in turn, and the data drive circuit 240 changes the polarity of data drive signals applied to the pixel units in the rows G3, G4, G7 and G8 in the pixel units in the column D1 from negative polarity to positive polarity in turn (e.g. by providing high level to the pixel units as discussed).

For example, the data drive circuit 240 may further be configured to apply data drive signals with opposite polarities to the pixel units in adjacent columns in any one of the first polarity inversion driving phase 201 and the second polarity inversion driving phase 202. For example, as shown in FIG. 4-*c*, the data drive circuit 240 may be configured to provide a data drive signal (the square wave drive signal represented as D1 in FIG. 4-*c*) to the column D1, and to provide the pixel units in the column D2 with another data drive signal with a polarity opposite to the polarity of the column D1 (the square wave drive signal represented as D2 in FIG. 4-*c*). Also for example, the data drive circuit 240 may be configured to provide the odd columns (e.g. the columns D1, D3, D5 and D7) with the same data drive signal as the column D1, and to provide the even columns (e.g. the columns D2, D4, D6 and D8) with a data drive signal with a polarity opposite to the polarity of the column D1. For example, the data drive circuit 240 may be configured to apply a negative polarity to the pixel units in columns D1, D3, D5 and D7 in the plurality of rows of the first pixel units 221, and to apply a positive polarity to the pixels units in columns D2, D4, D6 and D8 in the plurality of rows of the first pixel units 221, in the first polarity inversion driving phase 201. Also for example, the data drive circuit 240 may be configured to apply a positive polarity to the pixel units in columns D1, D3, D5 and D7 in the plurality of rows of the second pixel units 222, and to apply a negative polarity to the pixels units in columns D2, D4, D6 and D8 in the plurality of rows of the second pixel units 222, in the second polarity inversion driving phase 202.

For example, as shown in FIG. 4-*b*, for each frame image (e.g., Jth image, J+1 th image), two pixel units in the column direction are defined as a pixel subset, and two pixel units in each pixel subset have the same polarity, and each pixel subset maintains a polarity opposite to the polarities of its adjacent up, down, left and right four pixel subsets. That is, the pixel voltage polarity diagram of each frame image is identical with the pixel voltage polarity diagram of the column 2-dot inversion driving method. Therefore, the driving method carried out by the scan drive circuit 230 and the data drive circuit 240 of the another display panel 200 provided according to the present embodiments can attain a similar display effect to the column 2-dot inversion driving method.

For example, as shown in FIG. 4-*c*, for any column of pixel units, the data drive waveform of the driving method carried out by the scan drive circuit 230 and the data drive circuit 240 of the another display panel 200 provided according to the present embodiments is similar to the data drive waveform of driving method as shown in FIG. 3-*c*, i.e., similar to the data drive waveform of column inversion. Since in the refresh time of one frame image, for each column of pixel units, the data drive circuit 240 is only required to change the polarity of the applied signals once, the power consumption of the drive mode provided by the present embodiments is the same with that of column inversion. That is, the driving method according to the present embodiments may achieve the same display effect as the column 2-dot inversion with the same power consumption as column inversion. Therefore, the another display panel 200 provided by the present embodiments achieves the purpose of using a low power consumption drive mode for reaching a good display effect. That is, the another display panel 200 provided by the present embodiments reduces the power consumption of polarity inversion under the condition that a display effect is guaranteed.

For example, the number of rows of the adjacent first pixel units 221 and second pixel units 222 comprised in the array of pixel units 220 of the another display panel 200 provided according to some embodiments of the present disclosure is merely illustrative, and according to actual application requirements, the number of rows of the adjacent first pixel units 221 and second pixel units 222 comprised in the array of pixel units 220 may be in the equal or unequal form. For example, the number of rows of the adjacent first pixel units 221 and second pixel units 222 comprised in the array of pixel units 220 may be set as 3 or 5 or other numbers that satisfy actual application requirements. Again for example, the number of rows of the adjacent first pixel units 221 and second pixel units 222 comprised in the array of pixel units 220 may be set as 2 and 4 or other numbers that satisfy actual application requirements. The embodiments of the present disclosure do not make specific limitation.

For example, FIG. 5-*a* is an illustrative block diagram showing a further display panel 300 provided according to some embodiments of the present disclosure. As shown in FIG. 5-*a*, the display panel 300 comprises an array of pixel units 320, a scan drive circuit 330 and a data drive circuit 340. For example, FIG. 5-*b* is a schematic diagram showing a driving method carried out by the array of pixel units 320, the scan drive circuit 330 and the data drive circuit 340 of the further display panel 300 provided according to some embodiments of the present disclosure. FIG. 5-*c* is an illustrative drive waveform of the driving method shown in FIG. 5-*b*.

For example, as compared with the display panel, the array of pixel units and the data drive circuit shown in FIGS. 3-*a* to 3-*c*, as shown in FIG. 5-*b* and FIG. 5-*c*, the data drive circuit 340 in the present embodiments may be configured to apply a first data drive signal to pixel units in column 4M+1 and pixel units in column 4M+2, and to apply a second data drive signal to pixel units in column 4M+3 and pixel units in column 4M+4, in any one of the first polarity inversion driving phase 301 and the second polarity inversion driving phase 302. The first data drive signal and the second data drive signal have opposite polarities, where M is an integer greater than or equal to zero and smaller than or equal to N/4−1, and N is a number of columns of the array of pixel units 320, which may be, e.g., a positive integer multiple of 4, but it is not limited thereto.

For example, as shown in FIG. 5-*c*, the data drive circuit 340 may be configured to provide a same first data drive signal (the square wave drive signal represented as D1 and D2 in FIG. 5-*c*) to the columns D1 and D2, and to provide the pixel units in the columns D3 and D4 with a second data drive signal with a polarity opposite to the polarity of the column D1 and D2 (the square wave drive signal represented as D3 and D4 in FIG. 5-*c*). Also for example, the data drive circuit 340 may be configured to provide the columns D1, D2, D5 and D6 with the same first data drive signal as the columns D1 and D2, and to provide the columns D3, D4, D7 and D8 with the second data drive signal with a polarity opposite to the polarity of the columns D1 and D2.

For example, the data drive circuit 340 may be configured to apply a negative polarity to the pixel units in columns D1, D2, D5 and D6 in the plurality of rows of the first pixel units 321, and to apply a positive polarity to the pixels units in columns D3, D4, D7 and D8 in the plurality of rows of the first pixel units 321, in the first polarity inversion driving phase 301. Also for example, the data drive circuit 340 may be instead configured to apply a positive polarity to the pixel units in columns D1, D2, D5 and D6 in the plurality of rows of the second pixel units 322, and to apply a negative polarity to the pixels units in columns D3, D4, D7 and D8 in the plurality of rows of the second pixel units 322, in the second polarity inversion driving phase 302.

For example, as shown in FIG. 5-*b*, for each frame image (e.g., Jth image, J+1 th image), two pixel units in the row direction are defined as a pixel subset, two pixel units in each pixel subset have the same polarity, and each pixel subset maintains a polarity opposite to the polarities of its adjacent up, down, left and right four pixel subsets. That is, the pixel voltage polarity diagram of each frame image is identical with the pixel voltage polarity diagram of the row 2-dot inversion driving method. Therefore, the driving method carried out by the scan drive circuit 330 and the data drive circuit 340 of the further display panel 300 provided according to the present embodiments can attain a similar display effect to the row 2-dot inversion driving method.

For example, as shown in FIG. 5-*c*, for any column of pixel units, the data drive waveform of the driving method carried out by the data drive circuit 340 of the further display panel 300 provided according to the present embodiments is similar to the data drive waveform of driving method as shown in FIG. 3-*c*, i.e., similar to the data drive waveform of column inversion. Since in the refresh time of one frame image, for each column of pixel units, the data drive circuit 340 is only required to change the polarity of the applied signals once, the power consumption of the driving method provided by the present embodiments is the same with that of column inversion. That is, the driving method according to the present embodiments may achieve the same display effect as the row 2-dot inversion with the same power consumption as column inversion. Therefore, the further display panel 300 provided by the present embodiments achieves the purpose of using a low power consumption drive mode for reaching a good display effect. That is, the further display panel 300 provided by the present embodiments reduces the power consumption of polarity inversion under the condition that a display effect is guaranteed.

For example, the number of columns of pixel units comprised in the array of pixel units 320 to which the first date drive signal is applied and the number of columns of pixel units comprised in the array of pixel units 320 to which the second date drive signal is applied, in any one of the first polarity inversion driving phase 301 and the second polarity inversion driving phase 302 by the data drive circuit 340 of the further display panel 300 provided according to some embodiments of the present disclosure are merely illustrative, and according to actual application requirements, the number of columns of pixel units comprised in the array of pixel units 320 to which the first date drive signal is applied and the number of columns of pixel units comprised in the array of pixel units 320 to which the second date drive signal is applied, by the data drive circuit 340 may be in an equal or unequal form. For example, the number of columns of pixel units comprised in the array of pixel units 320 to which the first date drive signal is applied and the number of columns of pixel units comprised in the array of pixel units 320 to which the second date drive signal is applied, by the data drive circuit 340 may be set as 3 or 5 or other numbers that satisfy actual application requirements. Again for example, the number of columns of pixel units comprised in the array of pixel units 320 to which the first date drive signal is applied and the number of columns of pixel units comprised in the array of pixel units 320 to which the second date drive signal is applied, by the data drive circuit 340 may be set as 2 and 4 or other numbers that satisfy actual application requirements. The embodiments of the present disclosure do not make specific limitations.

For example, FIG. 6-*a* is an illustrative block diagram showing a further display panel 400 provided according to some embodiments of the present disclosure. As shown in FIG. 6-*a*, the display panel 400 comprises an array of pixel units 420, a scan drive circuit 430 and a data drive circuit 440. For example, FIG. 6-*b* is a schematic diagram showing a driving method carried out by the array of pixel units 420, the scan drive circuit 430 and the data drive circuit 440 of the further display panel 400 provided according to some embodiments of the present disclosure. FIG. 6-*c* is an illustrative drive waveform of the driving method shown in FIG. 6-*b*.

For example, as compared with the display panel, the array of pixel units, and the driving method shown in FIGS.

3-*a* to 3-*c*, as shown in FIG. 6-*b* and FIG. 6-*c*, the array of pixel units 420 may comprise a plurality of rows of first pixel units 421, a plurality of rows of second pixel units 422, a plurality of rows of third pixel units 423, and a plurality of rows of fourth pixel units 424. For example, the first pixel units 421 may comprise pixel units in row G1 and in row G3, the second pixel units 422 may comprise pixel units in row G2 and in row G4, the third pixel units 423 may comprise pixel units in row G5 and in row G7, and the fourth pixel units 424 may comprise pixel units in row G6 and in row G8.

For example, the scan drive circuit 430 may be configured such that an image scan period for driving the array of pixel units 420 comprises a first polarity inversion driving phase 401 continuous in time, a second polarity inversion driving phase 402 continuous in time, a third polarity inversion driving phase 403 continuous in time, and a fourth polarity inversion driving phase 404 continuous in time. For example, the first polarity inversion driving phase 401 as shown in FIG. 6-*c* is a period of time from J to J+2/8 or a period of time from J+1 to J+1+2/8; the second polarity inversion driving phase 402 is a period of time from J+2/8 to J+4/8 or a period of time from J+1+2/8 to J+1+4/8; the third polarity inversion driving phase 403 is a period of time from J+4/8 to J+6/8 or a period of time from J+1+4/8 to J+1+6/8; the fourth polarity inversion driving phase 404 is a period of time from J+6/8 to J+1 or a period of time from J+1+6/8 to J+2.

For example, the scan drive circuit 430 may be further configured to scan the plurality of rows of the third pixel units 423 in the third polarity inversion driving phase 403, and scan the plurality of rows of the fourth pixel units 424 in the fourth polarity inversion driving phase 404, and the data drive circuit 440 changes polarities of data drive signals applied to the plurality of rows of the third pixel units 423 and the plurality of rows of the fourth pixel units 424 in the third polarity inversion driving phase 403 and the fourth polarity inversion driving phase 404, respectively.

For example, in the first polarity inversion driving phase 401 (e.g., J–J+2/8), the scan drive circuit 430 may turn on pixel units in rows G1 and G3 in turn, and the data drive circuit 440 may change the polarity of data drive signals applied to the pixel units in rows G1 and G3 and column D1 from positive polarity to negative polarity in turn (e.g. by providing low level to the pixel units as discussed). Also for example, in the second polarity inversion driving phase 402 (e.g., J+2/8–J+4/8), the scan drive circuit 430 may turn on pixel units in rows G2 and G4 in turn, and the data drive circuit 440 may change the polarity of data drive signals applied to the pixel units in rows G2 and G4 and column D1 from negative polarity to positive polarity in turn (e.g. by providing high level to the pixel units as discussed). Again for example, in the third polarity inversion driving phase 403 (e.g., J+4/8–J+6/8), the scan drive circuit 430 may turn on pixel units in rows G5 and G7 in turn, and the data drive circuit 440 may change the polarity of data drive signals applied to the pixel units in rows G5 and G7 and column D1 from positive polarity to negative polarity in turn (e.g. by providing low level to the pixel units as discussed). Again for example, in the fourth polarity inversion driving phase 404 (e.g., J+6/8–J+1), the scan drive circuit 430 may turn on pixel units in rows G6 and G8 in turn, and the data drive circuit 440 may change the polarity of data drive signals applied to the pixel units in rows G6 and G8 and column D1 from negative polarity to positive polarity in turn (e.g. by providing high level to the pixel units as discussed).

For example, the data drive circuit 440 is further configured to apply data drive signals with opposite polarities to the pixel units in adjacent columns in any one of the first polarity inversion driving phase 401, the second polarity inversion driving phase 402, the third polarity inversion driving phase 403 and the fourth polarity inversion phase 404. For example, as shown in FIG. 6-*c*, the data drive circuit 440 may be configured to provide a data drive signal (the square wave drive signal represented as D1 in FIG. 6-*c*) to the column D1, and to provide the pixel units in the column D2 with another data drive signal with a polarity opposite to the polarity of the column D1 (the square wave drive signal represented as D2 in FIG. 6-*c*). Also for example, the data drive circuit 440 may be configured to provide the odd columns (e.g. the columns D1, D3, D5 and D7) with the same data drive signal as the column D1, and to provide the even columns (e.g. the columns D2, D4, D6 and D8) with a data drive signal with a polarity opposite to the polarity of the column D1. For example, the data drive circuit 440 may be configured to apply a negative polarity to the pixel units in columns D1, D3, D5 and D7 in the plurality of rows of the first pixel units 421, and to apply a positive polarity to the pixels units in columns D2, D4, D6 and D8 in the plurality of rows of the first pixel units 421, in the first polarity inversion driving phase 401. Also for example, the data drive circuit 440 may further be configured to apply a positive polarity to the pixel units in columns D1, D3, D5 and D7 in the plurality of rows of the second pixel units 422, and to apply a negative polarity to the pixels units in columns D2, D4, D6 and D8 in the plurality of rows of the second pixel units 422, in the second polarity inversion driving phase 402. Also for example, the data drive circuit 440 may further be configured to apply a negative polarity to the pixel units in columns D1, D3, D5 and D7 in the plurality of rows of the third pixel units 423, and to apply a positive polarity to the pixels units in columns D2, D4, D6 and D8 in the plurality of rows of the first pixel units 423, in the third polarity inversion driving phase 403. Also for example, the data drive circuit 440 may further be configured to apply a positive polarity to the pixel units in columns D1, D3, D5 and D7 in the plurality of rows of the fourth pixel units 424, and to apply a negative polarity to the pixels units in columns D2, D4, D6 and D8 in the plurality of rows of the fourth pixel units 424, in the fourth polarity inversion driving phase 404.

For example, as shown in FIG. 6-*b*, for each frame image (e.g., Jth image, J+1 th image), each pixel unit maintains a polarity opposite to the polarities of its adjacent up, down, left and right four pixel subsets. That is, the pixel voltage polarity diagram of each frame image is identical with the pixel voltage polarity diagram of the dot inversion driving method. Therefore, the further display panel 400 provided by the present embodiments can attain a similar display effect to the dot inversion driving method.

For example, as shown in FIG. 6-*c*, in the refresh time of one frame image, for any column of pixel units, for each column of pixel units, the data drive circuit 440 is required to change the polarity of the applied signals three times, so the power consumption of the driving method provided by the present embodiments is higher than that of column inversion but far less than that of dot inversion. Therefore, the further display panel 400 provided by the present embodiments reduces the power consumption of polarity inversion under the condition that a display effect is guaranteed.

For example, the number of polarity inversion driving phases comprised in an image scan period for driving the array of pixel units in the further display panel 400 provided according to some embodiments of the present disclosure is merely illustrative, and according to actual application requirements, the image scan period may comprise more polarity inversion driving phases. For example, the image scan period may further comprise a fifth polarity inversion driving phase and a sixth polarity inversion driving phase. The embodiments of the present disclosure do not make specific limitations.

At least some embodiments of the present disclosure provide a display device that may comprise a display panel according to any embodiments of the present disclosure. For example, the display device may be a cellular phone, a tablet computer, a television set, a display, a notebook computer, a digital frame, a navigator, or any product or component having a display function.

For example, FIG. 7 is an illustrative block diagram showing a display device 10 provided according to another embodiments of the present disclosure. The display device 10 may comprise a display panel according to any embodiments of the present disclosure, e.g., display panel 100, display panel 200, display panel 300, or display panel 400. It should be noted that, other indispensable components (e.g., control device, image data encoding/decoding device, clock circuit and etc.) of the display device 10 should be possessed by the display device, as should be appreciated by those skilled in the art, and thus are omitted here, and should not be construed as limiting the embodiments of the present disclosure. By making an image scan period for driving the array of pixel units comprise at least a first polarity inversion driving phase continuous in time and a second polarity inversion drive state continuous in time, the display panel 10 provided by the embodiments of the present disclosure reduces the power consumption of polarity inversion under the condition that a display effect is guaranteed.

For example, based on the same inventive concept, at least some embodiments of the present disclosure provide a method of driving a display device comprising: scanning a plurality of rows of first pixel units in a first polarity inversion driving phase continuous in time, scanning a plurality of rows of second pixel units in a second polarity inversion driving phase continuous in time, at least two rows of the first pixel units or at least two rows of the second pixel units being not adjacent to each other; and changing polarities of data drive signals applied to the plurality of rows of the first pixel units and the plurality of rows of the second pixel units in the first polarity inversion driving phase and the second polarity inversion driving phase, respectively.

For example, FIG. 8 is a method of driving a display device provided according to further embodiments of the present disclosure. By taking the case shown in FIGS. 3-*b* and 3-*c* as an example, as shown in FIG. 8, the method of driving the display device may comprise the following operations:

S10: scanning a plurality of rows of first pixel units in a first polarity inversion driving phase continuous in time, and changing a polarity of data drive signals applied to the plurality of rows of the first pixel units;

S20: scanning a plurality of rows of second pixel units in a second polarity inversion driving phase continuous in time, and changing a polarity of data drive signals applied to the plurality of rows of the second pixel units.

For example, the first pixel units comprise pixel units in odd rows (e.g., G1, G3, G5 and G7), and the second pixel units comprise pixel units in even rows (e.g., G2, G4, G6 and G8).

For example, it is possible to scan pixel units in odd rows in the first polarity inversion driving phase (e.g., J–J+1/2), and to change the polarity of data drive signals applied to the pixel units in column D1 in the plurality of rows of the first pixel units from positive polarity to negative polarity in turn. Also for example, it is possible to scan pixel units in even rows in the second polarity inversion driving phase (e.g., J+1/2–J+1), and to change the polarity of data drive signals applied to the pixel units in the column D1 in the plurality of rows of the second pixel units from negative polarity to positive polarity in turn. Again for example, it is possible to scan pixel units in odd rows in the first polarity inversion driving phase (e.g., J+1–J+3/2), and to change the polarity of data drive signals applied to the pixel units in the column D1 in the plurality of rows of the first pixel units from negative polarity to positive polarity in turn.

For example, it is possible to apply data drive signals with opposite polarities to pixel units in adjacent columns in any one of the first polarity inversion driving phase and the second polarity inversion driving phase. For example, it is possible to apply a negative polarity to pixel units in columns D1, D3, D5 and D7 in the plurality of rows of the first pixel units, and to apply a positive polarity to the pixels units in columns D2, D4, D6 and D8 in the plurality of rows of the first pixel units, in the first polarity inversion driving phase. Also for example, it is possible to apply a positive polarity to pixel units in columns D1, D3, D5 and D7 in the plurality of rows of the second pixel units, and to apply a negative polarity to the pixels units in columns D2, D4, D6 and D8 in the plurality of rows of the second pixel units, in the second polarity inversion driving phase.

For example, as shown in FIG. 3-*b*, for each frame image (e.g., Jth image, J+1 th image), each pixel unit maintains a polarity opposite to the polarities of adjacent up, down, left, right four pixel units. That is, the pixel voltage polarity diagram of each frame image is identical with the pixel voltage polarity diagram of the dot inversion driving method. Therefore, the driving method provided by the embodiments can attain a similar display effect to the dot inversion driving method. For example, as shown in FIG. 3-*d*, the data drive waveform of the driving method provided by the present embodiments is similar to the data drive waveform of column inversion. Since in the refresh time of one frame image, for each column of pixel units, it is only required to change the polarity of the applied signals once, the power consumption of the driving method provided by the present embodiments is the same with that of column inversion. Therefore, the derive method provided by the present embodiments reduces the power consumption of polarity inversion under the condition that a display effect is guaranteed.

For example, the driving method according to the embodiments of the present disclosure is not limited to the attainment of the display effect similar to the dot inversion driving method, and it can also attain a display effect similar to the column 2-dot inversion driving method and the row 2-dot inversion driving method.

For example, in the driving method of another display device provided according to further embodiments of the present disclosure, as shown in FIG. 4-*b*, the first pixel units may comprise pixel units in row 4I+1 and in row 4I+2, and the second pixel units may comprise pixel units in row 4I+3 and in row 4I+4, where I is an integer greater than or equal to 0 and smaller than or equal to C/4–1, and C is a number of rows of the array of pixel units, which may be, e.g., a positive integer multiple of 4, but it is not limited thereto. In case where data drive signals with opposite polarities are applied to pixel units in adjacent columns in any one of the first polarity inversion driving phase and the second polarity inversion driving phase, for each frame image (e.g., Jth image, J+1 th image), two pixel units in the column direction are defined as a pixel subset, and two pixel units in each pixel subset have the same polarity, and each pixel subset maintains a polarity opposite to the polarities of its adjacent up, down, left and right four pixel subsets. That is, the pixel voltage polarity diagram of each frame image is identical with the pixel voltage polarity diagram of the column 2-dot inversion driving method. At this time, as shown in FIG. 4-*c*, in the refresh time of one frame image, for each column of pixel units, it is only required to change the polarity of the applied signals once, so the power consumption of the driving method provided by the present embodiments is the same with that of column inversion. Therefore, the driving method of the another display panel provided according to the further embodiments of the present disclosure can reduce the power consumption of polarity inversion under the condition that a display effect is guaranteed.

For example, further embodiments of the present disclosure provide a driving method of the further display device. As shown in FIG. 5-*b*, the driving method specifically comprises: applying a first data drive signal to pixel units in column 4M+1 and pixel units in column 4M+2, and applying a second data drive signal to pixel units in column 4M+3 and pixel units in column 4M+4, in any one of the first polarity inversion driving phase and the second polarity inversion driving phase, wherein the first data drive signal and the second data drive signal have opposite polarities, where M is an integer greater than or equal to zero and smaller than or equal to N/4−1, and N is a number of columns of the array of pixel units, which may be, e.g., a positive integer multiple of 4, but it is not limited thereto. In the above driving method, for each frame image, two pixel units in the row direction are defined as a pixel subset, and two pixel units in each pixel subset have the same polarity, and each pixel subset maintains a polarity opposite to the polarities of its adjacent up, down, left and right four pixel subsets. That is, the pixel voltage polarity diagram of each frame image is identical with the pixel voltage polarity diagram of the row 2-dot inversion driving method. At this time, the data drive waveform of the driving method is similar to the data drive waveform of driving method as shown in FIG. 3-*c*, i.e., similar to the data drive waveform of column inversion. Since in the refresh time of one frame image, for each column of pixel units, it is only required to change the polarity of the applied signals once, the power consumption of the driving method is the same with that of column inversion. Therefore, the driving method achieves the purpose of using a low power consumption drive mode for reaching a good display effect. That is, the driving method of the further display device provided by the further embodiments of the present disclosure reduces the power consumption of polarity inversion under the condition that a display effect is guaranteed.

For example, the driving method according to the embodiments of the present disclosure is not limited to including only the first polarity inversion driving phase and the second polarity inversion driving phase, and according to actual application requirements, more polarity inversion driving phases may be provided.

For example, further embodiments of the present disclosure provide a method of driving the further display device. As shown in FIGS. 6-*b* and 6-*c*, the driving method may further comprise: scanning the plurality of rows of the third pixel units in the third polarity inversion driving phase continuous in time, and scanning the plurality of rows of the fourth pixel units in the fourth polarity inversion driving phase continuous in time; and changing polarities of data drive signals applied to the plurality of rows of the third pixel units and the plurality of rows of the fourth pixel units in the third polarity inversion driving phase and the fourth polarity inversion driving phase, respectively. The power consumption of the driving method is higher than that of column inversion but far less than that of dot inversion. Therefore, the power consumption of polarity inversion can be reduced under the condition that a display effect is guaranteed. Description of the driving method may be seen from the contents related to the driving method in the embodiments of the display panel as shown in FIGS. 6-*a* to 6-*c*, and is omitted here.

The embodiments of the present disclosure provide a display panel, a display device, and a method of driving the display method. By making an image scan period for driving the array of pixel units comprise at least a first polarity inversion driving phase continuous in time and a second polarity inversion drive state continuous in time, the display panel, the display device, and the method of driving the display device reduce the power consumption of polarity inversion under the condition that a display effect is guaranteed.

Although the present disclosure has been described above in detail by use of general descriptions and embodiments, some modifications or variations may be made on the basis of the embodiments of the present disclosure, which is obvious to those skilled in the art. Therefore, all these modifications or variations made without departing from the spirit of the present disclosure all fall within the scope of protection of the present disclosure.

What is claimed is:

1. A display panel comprising an array of pixel units, wherein the array of pixel units comprises a plurality of pixel units aligned in an array, and comprises at least a plurality of rows of first pixel units and a plurality of rows of second pixel units, at least two rows of the first pixel units or at least two rows of the second pixel units being not adjacent to each other; and a scan drive circuit configured to scan the array of pixel units such that an image scan period for driving the array of pixel units comprises at least a first polarity inversion driving phase continuous in time and a second polarity inversion driving phase continuous in time; and a data drive circuit configured to provide data signals to the array of pixel units, wherein the scan drive circuit scans the plurality of rows of the first pixel units in the first polarity inversion driving phase, and scans the plurality of rows of the second pixel units in the second polarity inversion driving phase, and the data drive circuit changes polarities of data drive signals applied to the plurality of rows of the first pixel units in the first polarity inversion driving phase and changes polarities of data drive signals applied to the plurality of rows of the second pixel units in the second polarity inversion driving phase, wherein the data drive circuit is further configured to apply a first data drive signal to the pixel units in column 4M+1 and the pixel units in column 4M+2, and to apply a second data drive signal to the pixel units in column 4M+3 and the pixel units in column 4M+4, in any one of the first polarity inversion driving phase and the second polarity inversion driving phase, the first data drive signal and the second data drive signal have opposite polarities, where M is an integer greater than or equal to zero and smaller than or equal to N/4−1, and N is a number of columns of the array of pixel units.

2. The display panel according to claim 1, wherein the first pixel units comprise the pixel units in odd rows and the second pixel units comprise the pixel units in even rows; or the first pixel units comprise the pixel units in even rows and the second pixel units comprise the pixel units in odd rows.

3. The display panel according to claim 1, wherein the first pixel units comprise the pixel units in row 4I+1 and in row 4I+2, and the second pixel units comprise the pixel units in row 4I+3 and in row 4I+4, where I is an integer greater than or equal to zero and smaller than or equal to C/4−1, and C is a number of rows of the array of pixel units.

4. A display device comprising display panel, the display panel comprising:

an array of pixel units, wherein the array of pixel units comprises a plurality of pixel units aligned in an array, and comprises at least a plurality of rows of first pixel units and a plurality of rows of second pixel units, at least two rows of the first pixel units or at least two rows of the second pixel units being not adjacent to each other;

a scan drive circuit configured to scan the array of pixel units such that an image scan period for driving the array of pixel units comprises at least a first polarity inversion driving phase continuous in time and a second polarity inversion driving phase continuous in time; and a data drive circuit configured to provide data signals to the array of pixel units, wherein the scan drive circuit is configured to scan the plurality of rows of the first pixel units in the first polarity inversion driving phase, and scan the plurality of rows of the second pixel units in the second polarity inversion driving phase, and the data drive circuit is configured to change polarities of data drive signals applied to the plurality of rows of the first pixel units in the first polarity inversion driving phase and change polarities of data drive signals applied to the plurality of rows of the second pixel units in the second polarity inversion driving phase, wherein the data drive circuit is further configured to apply a first data drive signal to the pixel units in column 4M+1 and the pixel units in column 4M+2, and to apply a second data drive signal to the pixel units in column 4M+3 and the pixel units in column 4M+4, in any one of the first polarity inversion driving phase and the second polarity inversion driving phase, the first data drive signal and the second data drive signal have opposite polarities, where M is an integer greater than or equal to zero and smaller than or equal to N/4−1, and N is a number of columns of the array of pixel units.

5. The display device according to claim 4, wherein the first pixel units comprise the pixel units in odd rows and the second pixel units comprise the pixel units in even rows; or the first pixel units comprise the pixel units in even rows and the second pixel units comprise the pixel units in odd rows.

6. The display device according to claim 4, wherein the first pixel units comprise the pixel units in row 4I+1 and in row 4I+2, and the second pixel units comprise the pixel units in row 4I+3 and in row 4I+4, where I is an integer greater than or equal to zero and smaller than or equal to C/4−1, and C is a number of rows of the array of pixel units.

7. A driving method comprising:

scanning a plurality of rows of first pixel units of an array of pixel units in a first polarity inversion driving phase continuous in time, and scanning a plurality of rows of second pixel units of the array of pixel units in a second polarity inversion driving phase continuous in time, where at least two rows of the first pixel units or at least two rows of the second pixel units are not adjacent to each other, and an image scan period for driving the array of pixel units comprises at least the first polarity inversion driving phase and the second polarity inversion driving phase; and changing polarities of data drive signals applied to the plurality of rows of the first pixel units in the first polarity inversion driving phase and changing polarities of data drive signals applied to the plurality of rows of the second pixel units in the second polarity inversion driving phase, and applying a first data drive signal to the pixel units in column 4M+1 and the pixel units in column 4M+2, and applying a second data drive signal to the pixel units in column 4M+3 and the pixel units in column 4M+4, in any one of the first polarity inversion driving phase and the second polarity inversion driving phase, wherein the first data drive signal and the second data drive signal have opposite polarities, where M is an integer greater than or equal to zero and smaller than or equal to N/4−1, and N is a number of columns of the array of pixel units.

8. The driving method according to claim 7, wherein the first pixel units comprise pixel units in odd rows and the second pixel units comprise pixel units in even rows; or the first pixel units comprise pixel units in even rows and the second pixel units comprise pixel units in odd rows.

9. The driving method according to claim 7, wherein the first pixel units comprise the pixel units in row 4I+1 and in row 4I+2, and the second pixel units comprise the pixel units in row 4I+3 and in row 4I+4, where I is an integer greater than or equal to zero and smaller than or equal to C/4−1, and C is a number of rows of the array of pixel units.

* * * * *